United States Patent [19]

De Mets

[11] 4,420,299

[45] Dec. 13, 1983

[54] CONTINUOUS OPERATION PRESS

[75] Inventor: Albert De Mets, Roeselaare, Belgium

[73] Assignee: De Mets N.V., Izegem, Belgium

[21] Appl. No.: 321,564

[22] Filed: Nov. 16, 1981

[30] Foreign Application Priority Data

Nov. 14, 1980 [DE] Fed. Rep. of Germany ... 8030533[U]
May 26, 1981 [DE] Fed. Rep. of Germany ... 8115711[U]

[51] Int. Cl.[3] ..... B30B 5/06
[52] U.S. Cl. ..... 425/101; 425/371
[58] Field of Search ..... 425/101, 371

[56] References Cited

U.S. PATENT DOCUMENTS 3,521,552 7/1970 Knapp ..... 425/101

*Primary Examiner*—Maurice J. Welsh
*Attorney, Agent, or Firm*—Antonelli, Terry & Wands

[57] ABSTRACT

A continuous operation press for manufacturing and/or coating, veneering, etc., a single-layer or a multiple-layer board web made of a mat which includes wood chips, wood fibers, etc. The press includes a carrying run of an upper belt which continuously circulates at a preset constant speed and a carrying run of a lower belt, with both belts preferably being made of steel. A friction reducing arrangement such as a slide or friction reducing coating extends over an entire width of a press area and is disposed on an upper and lower abutment, with the entering belts sliding over the friction reducing coating. A pressurized liquid lubricant is supplied to the friction reducing coating. The friction reducing coating extends over at least a main press area as well as a calibration area in which upper and lower slide coating extend parallel to one another. A friction reducing coating may also be provided in the pre-press area with the respective friction reducing coatings being bent or inclined so as to form a press gap. The lubricant is fed to the friction reducing surface of the friction reducing coating through openings formed in the friction reducing coating, with the openings not extending as far as the lateral edge of the friction reducing coating but being spaced therefrom.

65 Claims, 6 Drawing Figures

CONTINUOUS OPERATION PRESS

The present invention relates to a press and, more particularly, to a continuous operation press for the manufacture and/or coating, veneering, etc. of a single layer of multi-layer board web made of a prefabricated material and/or a raw material, with the material including a particle containing lignocellulose and/or cellulose with at least one binder. Particles of the material may, for example, be wood chips, wood fibers, or a mat containing these materials which is adapted to enter between a supporting or carrier run of a lower continuously circulating constant speed belt and a supporting or carrying upper continuously circulating belt, with both of the belts being formed of, for example, steel. A friction reducing means such as, for example, a slide or friction reducing coating is provided which extends over an entire width of the press area of the press, with the slide coating being attached to an upper and lower abutment over which the entering belt slides, with the friction reducing means also being provided with a pressurized liquid lubricant.

A continuous operation press is proposed, in, for example, Offenlegungsschrift 25 11 878 werein a belt is guided by a large-diameter roller in a press gap area, with the press being constructed primarily for use as a prepress or a finishing press. In this proposed construction, the belt is stretched from a large diameter roller to a guide roller and, in this area, at an underside of the belt an abutment is provided to support the belt, with the abutment being provided with a slide foil or coating, with a lubricant being fed and discharged through arrow-shaped grooves in order to further reduce the friction between the belt and the slide foil. Since the slide foil coating extends in the prepress area up to a point above a height of the scattered or loose mat to be pressed, and since the belt is not pressed in a direction of the friction reducing means, a high volume of lubricant leakage may be expected because the lubricant may discharge virtually unimpeded at the lateral edges of the belt.

A disadvantage of the above proposed continuous press resides in the fact that such press is relatively expensive to manufacture. Additionally, due to the provision of the relatively large diameter rollers, the considerable constructional height must be tolerated.

A further disadvantage of the above proposed construction resides in the fact that it is very undesirable to provide a construction having a comparatively high lubricant leakage rate. Moreover, the proposed press is unsuitable for exerting high surface pressures so as to utilize the press as, for example, a finish press.

In, for example, Offenlegungsschrift 19 38 280, a press of a similar construction is proposed wherein, at an inlet side of the press, the press is provided with press rollers for guiding continuously circulating belts, with each of the belts including another continuously circulating apron conveyor which is also guided by means of two guide rollers. The front guide roller of the two guide rollers which guide the apron conveyors mark or delineate a beginning of another press zone and, in this area, the steel belts forming the respective conveying surfaces extend parallel to one another. In an area which is disposed forwardly of the press zone, as viewed in a direction of conveyance of the board web, the press gap is formed by the front press roller of the steel belt up to the beginning of the apron conveyors. In this front press area, the steel belt is arranged in virtually a single plane and is supported in a rear thereof by an abutment which is provided with a friction reducing slide coating made of a plastic material. In a direction extending vertically to the direction of conveyance, the individual areas of the slide coating are separated from one another by a transverse joint. Additionally, in an area of each of the joints a strip or rail is provided which extends transversely to the direction of conveyance and a pressurized liquid lubricant is fed to the transverse joints by way of a plurality of openings.

While a relatively simple abutment and friction reducing means such as a slide coating may be provided in the front press area of the last proposed press for supporting the steel belt stretched between the rollers, a disadvantage of this proposed press resides in the fact that it is necessary to provide expensive and cumbersome pre-press rollers.

Additionally, while in the front press area of the proposed press the slide coating has only a support function for the steel belt, this give rise to a very high coefficient of friction during operation so that, in addition to the steel belt, the apron conveyor must also circulate in the rear press area in order to be able to exert the necessary forward feed force on the belt; however, the dimensional accuracy of the boards to be manufactured in the process may be increased by use of the apron conveyor.

The aim underlying the present invention essentially resides in providing a press of the aforementioned type which does not require the use of expensive driven mechanical aids such as, for example, an apron conveyor or a press roller, and which is smaller in size and of a higher efficiency while nevertheless being capable of simultaneously producing boards of outstanding quality.

In accordance with advantageous features of the present invention, or the continuous-operation press, preferably for the manufacture and/or coating, veneering of a single-layer or multiple-layer board, is provided wherein a friction reducing means such as a slide coating extends over at least a main pressing area and calibration area behind the main press area and is provided over its length, as viewed in a direction of conveyance of the belts forming the upper and lower runs of the press. A lubricant is fed to the slide surface of the slide coating through openings which are made in the slide coating and which do not extend to the lateral edges of the slide coating.

The upper slide coating corresponding to the upper belt and lower slide coating corresponding to the lower belt extent, in a direction of conveyance, over the prepress area as well as the main press and calibration press area.

Advantageously, in accordance with the present invention, the upper and lower slide coatings in the prepress area are bent at least in certain areas thereof, obliquely or constantly with respect to one another thereby forming a press gap. The upper and lower slide coatings extend parallel to one another in the main press area and the calibration press areas located behind the pre-press area. Every lubricant discharge opening empties into the slide coating at some distance from the lateral edges of the slide coating and, depending upon a counter pressure created by the mat during operation of the press as well as the conveyance speed of the belts, the lubricant is fed under control and in certain quantities per unit of time to the openings and, if need be, the lubricant may be heated up to a certain pre-heating and/or curing or hardening temperature for the mat being treated.

The friction reducing means such as the slide coating may be disposed in the pre-press area and/or the main press area and/or the calibration areas of the continuous operation press, with the openings being situated at a predetermined distance from lateral edges of the press area.

In accordance with the present invention, each lubricant discharge opening empties into at least one channel, with a major portion of the length of each channel extending not at right angles to the direction of conveyance but rather parallel thereto.

In accordance with the present invention, the feed or supply of the lubricant to the friction reducing means is controlled on the basis of the counter pressure which develops during operation of the press as well as on the basis of the conveyance speed of the respective belts forming the upper and lower run.

The lubricant may, in accordance with the present invention, be heated to a high temperature and, preferably, be fed continuously in controllable quantities per unit of time through openings on the underside or reverse sides of the belt so as to enable the lubricant to heat up and/or cure the mat being processed with or without a simultaneous heat up of the abutments upon which the slide coatings are disposed.

Preferably, at least in certain areas, the slide coating of the present invention may be microfine or a larger porosity with the lubricant channels into which the lubricant discharge openings empty extending precisely parallel to the direction of conveyance of the mat being treated.

In accordance with the present invention, a set of channels which run parallel to each other may be provided, with several sets of the channels being situated or disposed one behind the other as viewed in a direction of conveyance of the board being processed; however, it is also possible in accordance with the present invention for the sets of channels disposed on behind the other to be staggered with respect to one another, as viewed in a direction of conveyance.

It is also possible in accordance with the present invention, for the channels of one set to be staggered in such a manner that the overhang between the channels of the next set, as viewed in a direction of conveyance, are arranged so as to be flush therewith.

Preferably, each channel has a width which is in excess of its depth, with the openings and channels being fairly far removed from the edges of the press area.

The rear edge of each channel may, in accordance with the present invention, as viewed in a direction of conveyance, be cut and, preferably, at least two openings are allocated to each channel, i.e., a front opening and a rear opening. The front opening and rear opening, as viewed in a direction of conveyance, are associated with the respective channels and, through the openings, the lubricant in the lubricant loop or circuit may be fed or discharged.

The front and rear openings are, in accordance with the present invention, disposed or situated on different sides of the press area with respect to the direction of conveyance. Advantageously, exactly one front and one rear opening is associated to each set of channels with every two adjacent channels of a set of channels having connected thereto a connecting channel.

The friction reducing means formed, for example, as a slide coating may consist of an abrasion-resistant plastic material such as, for example, polytetrafluorethylene. The slide coating of the present invention is bent more and more forming the press area of the contracting press gap and, advantageously, each individual set of channels may be separately pressure loaded, with two outer channels of each set of channels being approximately half as far from the lateral edge of the press area as they are apart.

Advantageously, the lubricant is, in accordance with the present invention, fed continuously or intermittently to each lubricant discharge opening in the pre-press and/or main press and/or calibration area at a constant or controllable variable pressure. A seal is provided which extends transversely over an entire width of a front entrance to the press area, with the seal being in solid contact with undersides of the belts forming the upper and lower runs. A further seal may be provided at the rear end of the press area which extends over an entire width of the rear end of the press area and further seals may be mounted on each side of the press area and be disposed in a direction parallel to the direction of conveyance. Preferably, the seal is provided along the front, rear, and lateral sides of the press area are constructed so as to be made of a single piece and include a block or the like made of an elastic plastic material, with the block terminating in a sealing lip having a sealing edge thereon. The lip is adapted to be biased or press against the belt by way of a counter pressure bearing, which may be formed, for example, as a plastic strip and disposed in a channel of a retainer.

The retainer includes passages for accommodating the lubricant which discharges at the lateral sides of the belt as well as for accommodating the lubricant retained by the sealing edge of the lip thereby absorbing any lubricant leakage.

According to the present invention, the upper belt forming the upper run of the continuous operation press is wider than the lower belt and strippers are attached at lateral edges of the front of the upper belt. The strippers may, for example, be disposed so as to extend obliquely with respect to the direction of conveyance of the board being processed.

The slide coating may, for example, consist of rubber, preferably silicone rubber of Viton as well as polytetrafluorethylene.

With the slide coating formed of rubber, rubber is preferably heat resistant and/or oil resistant and, advantageously, the slide coating has a shore hardness of 50–70.

The lubricant may, in accordance with the present invention consist of an oil or an oil that is doped and have a viscosity of 50–2000 cst.

The metal belts and/or the press may be heated in the press area and, the slide coating may, for example, be vulcanized onto the abutment means. It is also possible for the slide coating, formed of a plastic material, to be cast onto a perforated plate and cured thereat. The perforated plate may be disposed on the abutment or secured thereto by, for example, welding or gluing. Additionally, the slide coating may be constructed so as to be at least deformable by sheer forces, that is, the slide coating may be elastically deformable by sheer forces.

The plastic material of the slide coating may be an elastic plastic material and, in each press area the slide coating may extend integrally over its length of the press area in a direction of conveyance.

Since the friction reducing means of the present invention formed, for example, as a slide coating lubricated by a liquid lubricant is present at least in the main press area and in the calibration area behind it, and, preferably, throughout the entire press area including the pre-press area, the production costs for the press are overall considerably lowered by comparison with previously proposed continuous operation presses.

In contradistinction to the provision of channels which extend vertically with respect to the direction of conveyance, with the discharge lubricant openings present in the slide coating make it possible not only to realiably lubricate the entire press area but also to exert a lower lubricant pressure while simultaneously making an optimum lubricant throughflow in order to allow considerably lower friction values and thus a higher throughflow performance as well as a reduction in the drive energy required for the press.

A considerably significant feature of the present invention resides in the fact that oil pockets are situated or disposed in an area around each opening in the slide coating with the pockets migrating behind the conveyance speed of the continuously circulating belt and, quite suprisingly, this leads to a pronounced extremely small coefficient of friction. On the other hand, with the transverse strips specifically preventing the lubricant from being transported away from the belt, in contrast to the theory of the present invention, the lubricant in the area of the channel is subjected only to static pressure but due to this a certain throughflow quantity cannot be achieved.

A further advantage of the present invention resides in the fact that because of the higher lubricant throughflow, it is quite easy to transfer an adequate quantity of heat if the lubricant is first heated up to a certain temperature so that the amount of heat released through the belt entering the board or mat to be pressed for the purposes of heating, curing, or setting has a favorable effect on the quality and dimensional accuracy of the board to be produced.

Yet a further advantage of the present invention resides in the fact that a continuous operation press is provided wherein press rollers, as heretofore required in previously proposed continuous operation presses, are completely omitted since in the press area only slide coatings which are lubricated by the lubricant need be provided.

It is even particularly advantageous to build the sliding coatings as well as the abutments in a modular design and in such a manner that they may be retrofitted. In this case, a cross joint not a parting or separating may be obtained if, in the line of the individual modular parts, the seamless slide coating of the press area is formed which terminates the slip in the press gap unevenly and, to a certain extent, abrutly.

A suprising outcome of the present invention resides in the fact that, without overly large drive rollers sufficient static friction is exerted at the surfaces of the rollers to transmit the tensile force to the reverse or underside of the belt which has been prelubricated with the liquid lubricant. It is equally suprising that, with the present invention, a stable slide film or slide pressure film is formed which, in contradistinction to the construction proposed in German Pat. No. 2,400,762, causes no adhesion effect.

By the provision of one opening which is at the rear as viewed in the direction of conveyance and one which is in the front, with the front and rear openings being associated with a channel, through these openings the lubricant may be fed or drained so that when there is an adequate pressure not only a stable slide film can be ensured between the continuously circulating belt at the projections bordering on the side edges of the channels and the underside of the continuously circulating belt. Additionally, an adequate amount of heat transported by the lubricant may be ensured for the mat to be pressed through the continuously circulating belts and, in the later case, the lubricant may be conveyed at a relatively high delivery or supply speed in the lubricant circuit or loop.

While the width and depth of the channels of the present invention are constructed with an eye toward an optimum delivery speed for the lubricant, the channels should preferably be considerably wider than deep so that the lubricant flowing through each channel passes over a relatively large surface area on the underside of the belt in order to ensure a heat transfer. On the other hand, a certain maximum width of the channel must not be exceeded so that the pressure prevailing in each channel and imposed by the lubricant on the underside of the continuously circulating belt cannot prevent the belt from flexing towards the slide coating in the area of the channel.

Due to the attainment of relatively good coefficience of friction, the invention ensures a high throughflow or output with an almost ideally uniform surface pressure on the board or mat while at the same time the structure of the press is simplier and uncomplicated and boards are produced which have good to very good thickness tolerances.

A still further advantage of the present invention resides in the fact that previously proposed or existing continuous operation presses may readily be retrofitted by, for example, securing the abutment with the slide coating attached to it as well as the seals and connections for the feeding and draining of lubricant at two base plates thereby forming a modular retrofit unit.

Accordingly, it is an object of the present invention to provide a continuous operation press for the manufacture and/or processing of boards which avoids, by simple means, shortcomings and disadvantages encountered in the prior art.

Another object of the present invention resides in providing a continuous operation press for the manufacture and/or processing of single layer or multi-layer boards which enables the boards to be manufactured at a lower cost and at a greater efficiency due to lower operating costs of the press.

A further object of the present invention resides in providing a continuous operation press for the manufacture and/or processing of boards which are simple in construction and therefore relatively inexpensive to manufacture.

A still further object of the present invention resides in providing a continuous operation press for the manufacturing and/or processing of boards which ensures the production of boards within acceptable tolerance ranges.

A still further object of the present invention resides in providing a continuous operation press for the manufacture of boards which optimizes the friction between respective elements of the press so as to provide for and ideal uniform surface pressure.

These and other objects, features, and advantages of the present invention will become more apparent from the following description when taken in connection with the accompanying drawings which show, for the purposes of illustration only, several embodiments in accordance with the present invention, and wherein.

Figure 1:
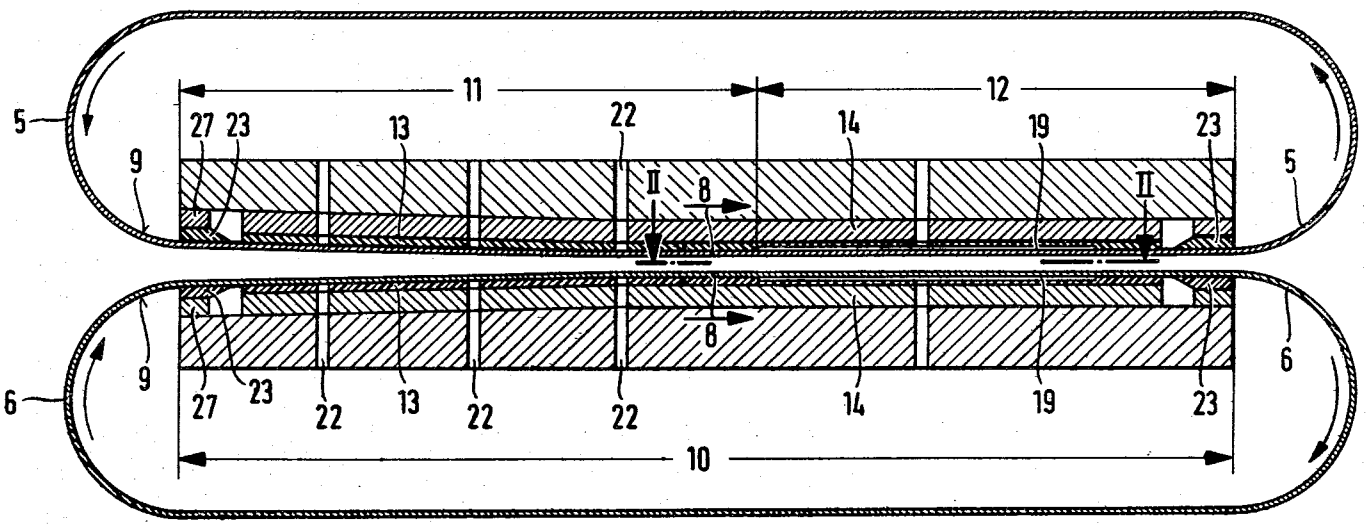
FIG. 1 is a partially schematic longitudinal cross section view through a press constructed in accordance with the present invention.

Referring now to the drawings wherein like reference numerals are used throughout the various views to designate like parts and, more particularly, to FIG. 1, according to this figure, a continuous operation press includes an upper continuously circulating belt 5 and a lower continuously circulating belt 6, with a mat 7 being adapted to be conveyed between the upper and lower continuously circulating belts 5, 6 in the direction indicated by the arrow 8, during a prepressing, main pressing, and calibration operation. A friction reducing means such as, for example, a slide coating 13 is provided on the undersides 9 of the belts 5, 6 facing away from the mat 7. The slide coating 13 extends throughout the entire press area 10, with the entire press area 10 including a pre-press area 11, a main press area and a claibration area 12. The slide coating 13 may, for example, be formed of rubber and be vulcanized onto abutments 14 disposed in the press area 10. The slide coatings 13 in the pre-press area 11 are arranged obliquely with respect to one another so as to form a press gap schematically represented in FIG. 1.

In certain areas of the press, modular slide coating units may be used which may be obliquely staggered with respect to one another and which are disposed one after the other in the direction of conveyance of the mat 7 until such modular units extend parallel in the main press area. It is also possible for the slide coating 13 in the pre-press area to be continuously bent more and more until it reaches a beginning of the main press area 12.

Figure 2:
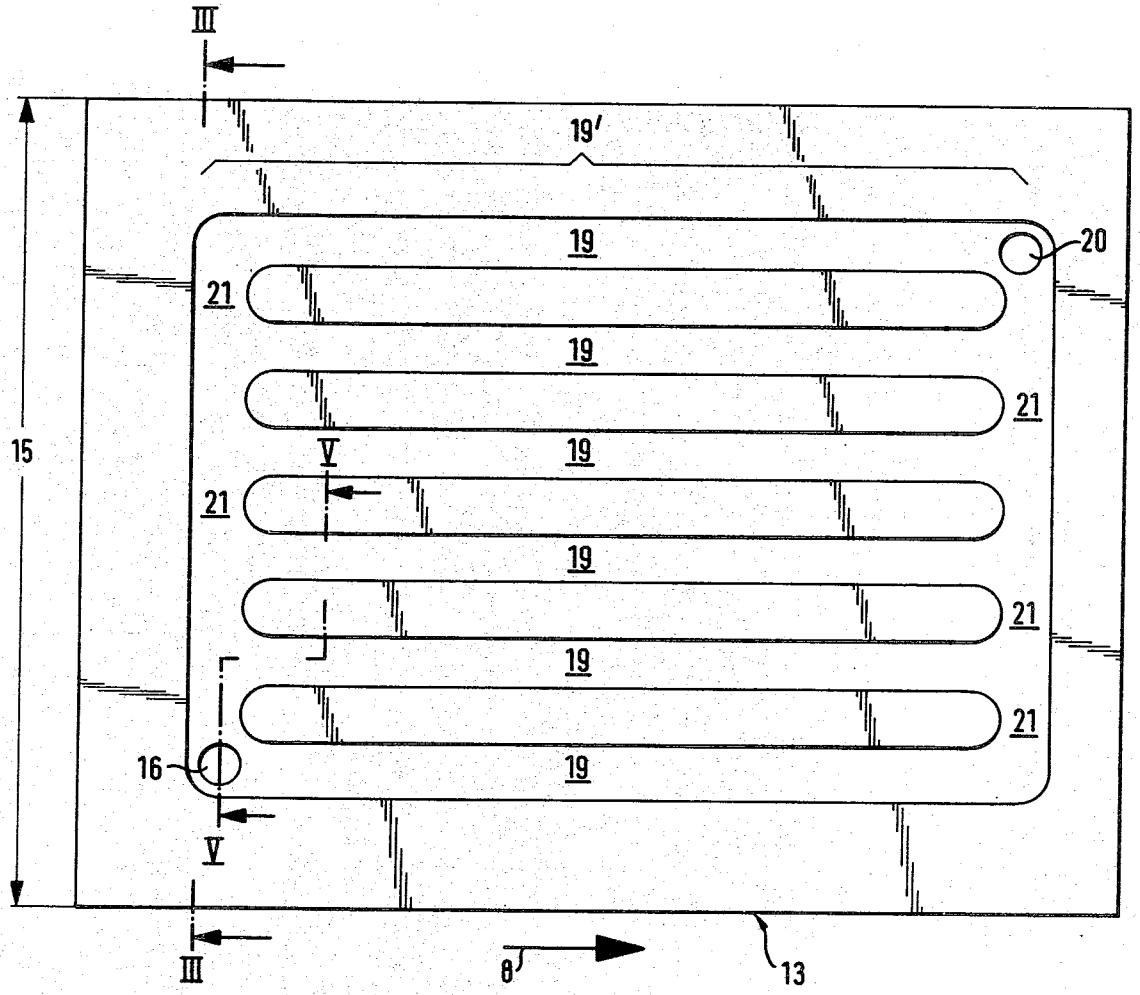
FIG. 2 is a top view taken in the direction of the line II—II in FIG. 1 with a belt of the press removed for clarity.

As shown in FIG. 2, which represents a top view of the slide coating 13, the slide coating 13 extends over an entire width 15 as well as length of the entire press area of which only the finishing press area and calibration area are shown in FIG. 2. In an area which is forwardly with respect to the direction of conveyance, an opening 16 is provided, with an opening 20 being disposed to the rear, with respect to the direction of conveyance 8. The two openings 16, 20 are disposed at diagonally opposite positions and are each adapted to empty into a channel 19.

As shown in FIG. 2, between the two outer channels 19, i.e., the channels to the left and right of FIG. 2, a plurality of other channels 19 are provided with each two adjacent channels 19 being interconnected by a connecting channel 21.

Figure 4:
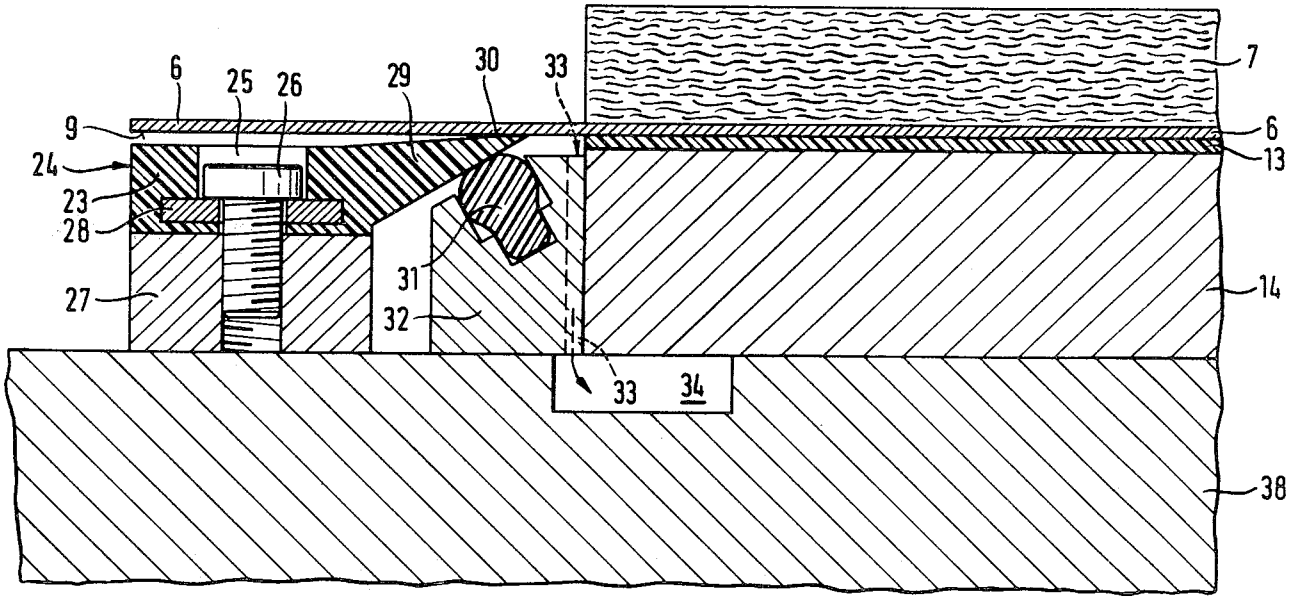
FIG. 4 is a cross sectional view, on an enlarged scale, of a detailed designated IV in FIG. 3.

A seal 23 (FIGS. 1, 4) to be described more fully hereinbelow, surrounds the entire press area in order to provide a means for preventing a leakage of the lubricant supplied to the slide coating 13.

The seal 23 is arranged so as to surround the approximately rectangular press area 10 or the slide coating 13, which is also rectangular. Advantageously, the seal 23 is constructed as a single piece and encompasses the entire press area 10. The seal, as shown most clearly in FIG. 4, includes a sealing block generally designated by the reference numeral 24 having an opening 25 adapted to accommodate a fastener such as a screw 26 which is threadably inserted into a retention block 27. A head of the screw 26 is adapted to fit snuggly against a support disk 28 such as, for example, a washer or a flat iron bar 21 which is provided with corresponding openings so as to accommodate the shaft of the screw 26. The support disk or flat iron bar 28 may be vulcanized in the seal 23 with the fastening arrangement being so constructed so that overall the seal 23 is pressed flat against the retention block 27. The seal 23 includes a lip 29 which terminates in a sealing edge 30 adapted to be urged snuggly against the underside 9 of the belt 6, with the lip 29 extending in a direction of the press area 10. The lip 29 is pressed tightly against the underside 9 of the belt 6 by a counter pressure bearing 31 which, for example, may be constructed as a strip of plastic material accommodated in a channel or the like of a retainer 32. The retainer 32 is provided with a passage generally designated by the reference numeral 33 which leads to a collecting channel 34 adapted to collect and accommodate lubricating oil fed to the slide coating 13.

Figure 3:
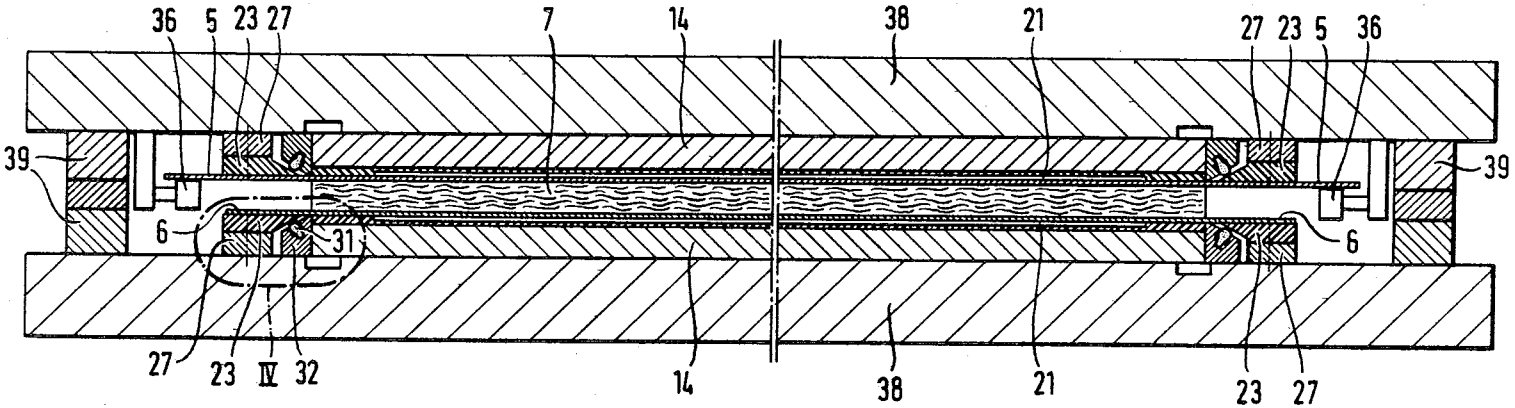
FIG. 3 is a cross sectional view taken along the line III—III in FIG. 2.

In order to enable the device of the present invention to be readily used as a retrofitting module for existing continuous presses, as shown in FIG. 3, the upper belt 5 is wider than the lower belt 6 and, on the underside 9 of the belt 5, a stripper 36 is provided which is adapted to contact the underside 9 of the belt 5 and scrape oil which seeps over lateral edges of the belt 5. Th two abutments 14 and retaining blocks 27 and 32 for the seal or the counter pressure bearing 31 are secured at a retaining plate 38 with feed and discharge connections for the lubricant, which are to be mounted on the sides, being omitted from the drawing in order to provide a simpler graphic depiction. The two retaining plates 38 are interconnected by connecting pieces 39 so that the modular unit as a whole may be inserted into other continuation operation presses with a minimum of time and labor as well as a minimum amount of adaptation work.

Figure 5:
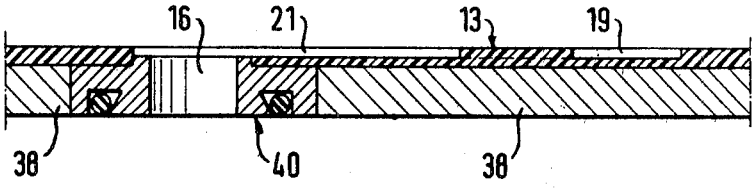
FIG. 5 is a cross sectional view taken along the line V—V in FIG. 2.

As shown in FIG. 5, the slide coating 13 may be vulcanized onto a retaining plate 38 forming channels 19 and the connecting channels 21 of the set of channels 19′ (FIG. 2). A special connecting piece generally designated by the reference numeral 40 may be provided around the openings 16 and 20 in order to enable a connection with lubricating openings or bores 22 of the lubricating circuit of the press.

Figure 6:
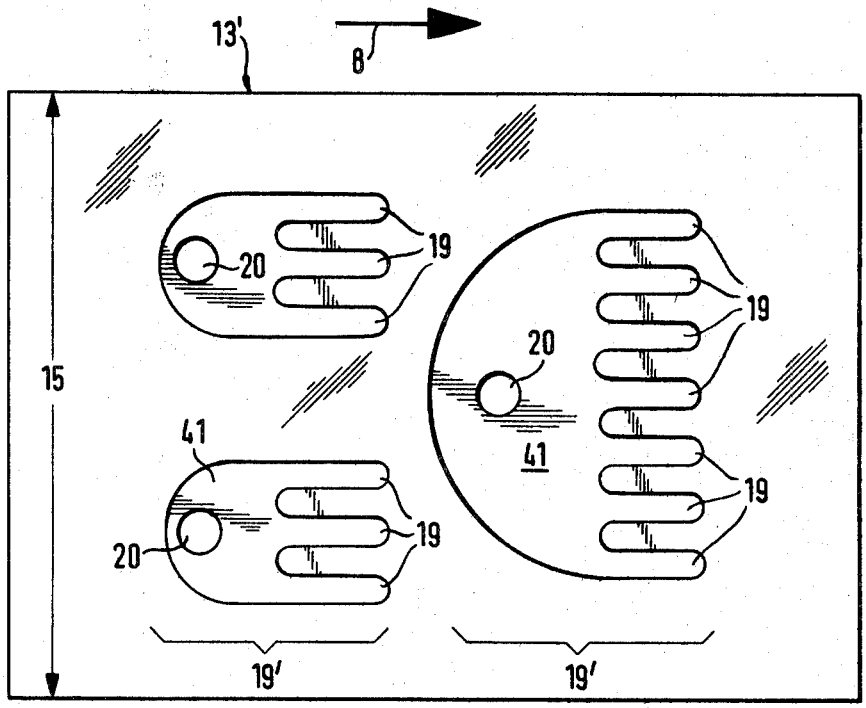
FIG. 6 is a top view similar to FIG. 2 of another embodiment in accordance with the present invention.

FIG. 6 provides a schematic representation of a further friction reducing means formed as, for example, a slide coating 13′. In the slide coating 13′ a plurality of channels extend parallel to the direction of conveyance 8 with the channels being interconnected by an approximately semi-circular recess in a forward end thereof, with respect to the direction of conveyance 8. As can readily be appreciated, the channels 19 forming channel set 19′ are disposed in mirror image with respect to the longitudinal center plane of the slide coating 13′. The lubricant feed opening 20 connected to the lubricant bores 22 empties or discharges into the semi-circular recess area 41 in each of the sets 19' of the channels 19. The sets 19' of the channels 19 can either be situated on one side of the longitudinal center line, i.e., the upper group 19' or the sets 19' may be disposed in mirror image with respect to the longitudinal center line as the set 19' of the channels 19 shown in the lower portion of FIG. 6.

In the main press area and the calibration area 12, it is not necessary for the channels to occupy at least three-quarters of the total surface of the press area and, preferably, in the main press and calibration area, the channels 19 occupy no more than half of the total surface of the press area. Additionally, the pressure under which the lubricant is fed may be adjusted in accordance with the preferably constant width of each channel 19 as well as the strength properties of the continuously circulating belts 5, 6 and the type of operation in which the press is being used, for example, a mat or veneer press.

While I have shown and described two embodiments in accordance with the present invention, it is understood that the same is not limited thereto but is susceptible of numerous changes and modifications as known to one having ordinary skill in the art and I therefore do not wish to be limited to the details shown and described herein, but intend to cover all such modifications as are encompassed by the scope of the appended claims.

I claim:

1. A continuous operation press for at least one of producing and treating a board web, the press having a press area including a main press area and a calibration area disposed rearwardly of a main press area, as viewed in a conveying direction of the board web, upper and lower belts for defining upper and lower carrying runs between which the board web is carried, the upper and lower belts being adapted to continuously circulate at a constant speed, characterized in that upper and lower abutment means extending substantially perpendicular to a conveying direction of the board web are provided and extend over an entire width of the press area of the press, the upper and lower abutment means are respectively disposed in proximity to an underside of the upper and lower belts, a friction reducing means is arranged on the respective abutment means in at least one of the main press area and calibration area, each friction reducing means including a friction reducing surface cooperable with the underside of the upper and lower belts, the friction reducing means extends over an entire width and length of at least one of the main pressing area and the calibration area, and means for supplying a lubricant to the friction reducing means including lubricant supplying openings formed in each of the friction reducing means at a position spaced from lateral edges of the friction reducing means.

2. A press according to claim 1, characterized in that the board web is formed of at least a single layer of one of a prefabricated material and a raw material imposed on at least one of lignocellulose-containing and cellulose-containing particles with at least one binder.

3. A press according to claim 2, characterized in that the material on the board web is at least one of wood chips, wood fibers, and a mat containing the material of the board web.

4. A press according to one of claims 1 or 3, characterized in that the press area further includes a pre-press area disposed forwardly of the main press area, as viewed in the conveying direction, and upper and lower abutment means is disposed in the pre-press area, a friction reducing means is disposed on the upper and lower abutment means in the pre-press area, the friction reducing means including a friction reducing surface cooperable with the underside of the upper and lower belts, the friction reducing means and the pre-press area extends over an entire width and length of the pre-press area and are positioned with respect to one another so as to form, at least in a portion of the pre-press area, a press gap, the friction reducing means in the main press area and calibration area are disposed in parallel, the lubricant supplying means includes further lubricant supply openings formed in the friction reducing means in the pre-press area, the further lubricant supply openings are spaced from the lateral edges of the friction reducing means in the pre-press area, and in that means are provided for controlling a volume per unit of time of lubricant supplied to the lubricant supplying openings in dependence upon at least one of a counter pressure created by the board web and a conveying speed of the belts.

5. A press according to claim 4, characterized in that means are provided for preheating the lubricant so as to enable at least one of a preheating and curing of the board web.

6. A press according to claim 5, characterized in that the friction reducing means extends over both the main pressing area and calibration area as well as the pre-pressing area, and in that the friction reducing means in the pre-press area are inclined with respect to one another so as to form the press gap.

7. A press according to claim 6, characterized in that a plurality of channel means are provided in each of the friction reducing means, with the lubricant supply openings respectively communicating with at least one of the channel means.

8. A press according to claim 7, characterized in that the channel means are arranged so as to extend in a direction substantially parallel to the conveying direction.

9. A press according to claim 7, characterized in that the channel means extend parallel to the conveying direction of the board web.

10. A press according to claim 7, characterized in that the plurality of channel means are divided into individual sets of channels.

11. A press according to claim 10, characterized in that the individual sets of channels are disposed one behind the other in the conveying direction of the board web.

12. A press according to claim 10, characterized in that the individual sets of channels are staggered with respect to each other and are disposed one behind the other in the conveying direction.

13. A press according to claim 12, characterized in that the sets of channels are staggered in such a manner that there is a flush overlap between the channels of adjacent sets in the conveying direction.

14. A press according to claim 13, characterized in that a width of each of the channels is greater than a depth thereof.

15. A press according to claim 8, characterized in that the lubricant supplying openings and associated channels are disposed a substantial distance from lateral edges of the press area.

16. A press according to claim 15, characterized in that a rear edge of each channel, as viewed in a conveying direction, is chamfered.

17. A press according to claim 15, characterized in that at least two lubricant supplying openings are associated with each channel.

18. A press according to claim 17, characterized in that the two lubricant supplying openings are respectively disposed at a front end and rear end of each friction reducing means, as viewed in the conveying direction.

19. A press according to claim 18, characterized in that the lubricant supplying openings at the front and rear ends are disposed in diagonally opposite positions of the respective friction reducing means.

20. A press according to claim 19, characterized in that the plurality of channel means are divided into individual sets of channels, one lubricant supplying opening is provided at the front end and rear end of each individual set of channels, as viewed in the conveying direction, and in that a connecting channel means is provided for connecting every two adjacent channels of the individual set of channels to each other.

21. A press according to one of claims 1 or 3, characterized in that the friction reducing surface is formed by a coating provided on the abutment means.

22. A press according to claim 21, characterized in that the coating is formed of an abrasion-resistant plastic material.

23. A press according to claim 22, characterized in that the press area further includes a pre-press are disposed forwardly of the main press area, as viewed in the conveying direction, an upper and lower abutment means is disposed in the pre-press area, a friction reducing means is disposed in the upper and lower abutment means in the pre-press area, the friction reducing means including a friction reducing surface cooperable with the underside of the upper and lower belts, the friction reducing means in the pre-press area extends over an entire width and length of the pre-press area, and in that the friction reducing means extends over both the main pressing area and the calibration area.

24. A press according to claim 23, characterized in that the friction reducing means of the pre-press area are positioned with respect to one another so as to form, at least in a portion of the pre-press area, a press gap.

25. A press according to claim 24, characterized in that a plurality of channel means are provided in each of the friction reducing means, with the lubricant supplying openings respectively communicating with at least one of the channel means, and in that the plurality of channel means are divided into individual sets of channels which are adapted to be separately press loaded with a lubricant.

26. A press according to claim 25, characterized in that outer channels of each individual set of channels are spaced from each other and spaced from lateral edges of the respective friction reducing means by a distance equal approximately to one half of the space between the outer channels.

27. A press according to claim 26, characterized in that a distance between the rearmost ends of the respective channels and the rearmost end of the friction reducing means, as viewed in the conveying direction, approximately corresponds to a distance from the lateral edges of the friction reducing means.

28. A press according to claim 25, characterized in that means are provided for one of continuously and intermittently feeding lubricant to each of the lubricant supplying openings and at least one of the main press area, pre-press area, and calibration area, at at least one of a constant and controllable variable pressure.

29. A press according to claim 1, characterized in that a seal means is fixedly mounted on the press at least in a vicinity of an entrance to the press area, as viewed in a direction of conveyance of the board web, the seal means extends over an entire width of the press area.

30. A press according to claim 29, characterized in that a seal means is fixedly mounted on the press in a vicinity of an exit of the press area extends transversely accross an entire width of the press area.

31. A press according to claim 30, characterized in that a seal means is mounted along each lateral side of the press area and extends in a direction parallel to the direction of conveyance.

32. A press according to claim 31, characterized in that the seal means at the entrance, exit, and along each of the lateral sides of the press area are formed as a single piece.

33. A press according to claim 32, characterized in that each said means includes a block portion having a lip thereon terminating in a sealing edge engagable with the underside of the lower belt.

34. A press according to claim 33, characterized in that means are provided for urging a lip means of each of the seal means against the underside of the upper and lower belts.

35. A press according to claim 34, characterized in that a retainer means is provided along the entrance and exit of the press area and along each lateral side thereof, and in that a channel means is provided in the retaininer means for accommodating the urging means.

36. A press according to claim 35, characterized in that the urging means is a bearing formed of a strip of plastic material.

37. A press according to claim 36, characterized in that means are provided in the retainer means for receiving lubricant from the belt and lubricant retained by the lip of the seal means.

38. A press according to claim 37, characterized in that the receiving means includes at least one passage means communicating with a lubricant accommodating chamber.

39. A press according to claim 38, characterized in that the upper belt has a width larger than a width of the lower belt, and in that stripper means are attached at lateral edges of the front of the upper belt.

40. A press according to claim 39, characterized in that the stripper means are arranged obliquely with respect to a direction of conveyance of the board web.

41. A press according to claim 39, characterized in that each friction reducing means includes a coating provided on the respective abutment means.

42. A press according to claim 41, characterized in that the coating is formed of a rubber material.

43. A press according to claim 42, characterized in that the rubber material is one of silicone rubber or Viton.

44. A press according to claim 41, characterized in that the coating is formed of polytetrafluorethylene.

45. A press according to claim 42, characterized in that the rubber material is heat resistant.

46. A press according to claim 42, characterized in that the rubber material is oil resistant.

47. A press according to claim 42, characterized in that the side coating has a shore hardness of 50–70.

48. A press according to claim 42, characterized in that the lubricant is oil.

49. A press according to claim 48, characterized in that the oil is doped.

50. A press according to claim 42, characterized in that the lubricant has a viscosity of 50–2000 cst.

51. A press according to one of claims 1 or 41, characterized in that the upper and lower belts are formed of a steel material and in that means are provided for heating the press area so as to enable at least one of the preheating and curing of the board web.

52. A press according to claim 41, characterized in that the coating is vulcanized onto the respective abutment means.

53. A press according to claim 4, characterized in that each friction reducing means includes a perforated plate mounted on the respective abutment means, and the friction reducing surface is formed by a friction reducing material provided on the perforated plate.

54. A press according to claim 53, characterized in that the friction reducing material is cast and cured on the perforated plate.

55. A press according to claim 54, characterized in that the friction reducing material is polytetrafluorethylene, and in that the perforated plate is mounted on the respective abutment means by one of a weld and adhesive.

56. A press according to claim 4, characterized in that each friction reducing means is constructed so as to be at least deformable by shear forces.

57. A press according to claim 4, characterized in that each friction reducing means is constructed so as to be elastically deformable by shear forces.

58. A press according to claim 4, characterized in that each friction reducing means is formed of a plastic material.

59. A press according to claim 4, characterized in that each friction reducing means is formed of an elastic plastic material.

60. A press according to claim 4, characterized in that in the main press area, the calibration area, and the pre-press area, the friction reducing means extend integrally over an entire length of each area, as viewed in a direction of conveyance of the board web.

61. A press according to claim 1, characterized in that the lubricant supplying openings are spaced at a substantial distance from lateral edges of the friction reducing means.

62. A press according to claim 1, characterized in that means are provided for controlling a supply of lubricant to the lubricant supplying openings in dependence upon at least one of a counter pressure caused by a board web and a conveyance speed of the belts.

63. A press according to claim 1, characterized in that means are provided for heating the lubricant to a high temperature with or without a simultaneous heating of the abutment means for at least one of heating and curing the board web, and in that means are provided for continuously feeding the lubricant in controlled quantites per unit of time to the lubricant supplying openings.

64. A press according to one of claims 1 or 4, characterized in that the friction reducing surface is formed by a coating provided on the respective abutment means, and in that the coating has a microfine porosity at least in certain areas thereof.

65. A press according to one of claims 1 or 4, characterized in that the friction reducing surface is formed by a coating provided on the respective abutment means, and in that the coating has a large porosity at least in certain areas thereof.

* * * * *